US006726605B2

(12) United States Patent
Chen

(10) Patent No.: US 6,726,605 B2
(45) Date of Patent: Apr. 27, 2004

(54) PUNCHING BAG HAVING SOLID HANGING STRUCTURE

(76) Inventor: Sherry Chen, P.O. Box 63-99, Taichung (TW), 406

( * ) Notice: Subject to any disclaimer, the term of this patent is extended or adjusted under 35 U.S.C. 154(b) by 110 days.

(21) Appl. No.: 10/195,089

(22) Filed: Jul. 10, 2002

(65) Prior Publication Data

US 2004/0009852 A1 Jan. 15, 2004

(51) Int. Cl.[7] ..... A63B 69/20
(52) U.S. Cl. ..... 482/87; 482/90; 482/83
(58) Field of Search ..... 482/83–90; 473/441, 473/442; 273/DIG. 20; D21/787

(56) References Cited

U.S. PATENT DOCUMENTS 923,379 A * 6/1909 Selfe ..... 482/83
1,269,559 A * 6/1918 Fauver
4,527,796 A * 7/1985 Critelli ..... 482/83
4,941,660 A * 7/1990 Winn et al. ..... 482/83
5,755,648 A * 5/1998 Kildani ..... 482/121
6,106,443 A 8/2000 Kuo ..... 482/83
6,558,298 B2 * 5/2003 Fields et al. ..... 482/87

* cited by examiner

*Primary Examiner*—Jerome W. Donnelly

(57) ABSTRACT

A punching bag includes a chamber for receiving a soft or resilient barrel, and a container received in the barrel and having a chamber for selectively receiving insert materials therein. The container includes one or more rings disposed on top for hanging purposes. The container includes a port for filling the insert materials into the container. The rings may be solidly disposed on top of the container for solidly hanging the punching bag to any support frames or members. The bag includes an upper cover having one or more orifices for receiving the rings.

3 Claims, 3 Drawing Sheets

PUNCHING BAG HAVING SOLID HANGING STRUCTURE

BACKGROUND OF THE INVENTION

1. Field of the Invention

The present invention relates to a punching bag, and more particularly to a punching bag including a solid hanging structure for stably hanging purposes.

2. Description of the Prior Art

Various kinds of typical punching bags have been developed and hung onto the supporting members, for punching aid or for training purposes, and comprise a substantially cylindrical bag having a number of soft or resilient materials or insert materials, such as rubber or plastic materials engaged therein. The soft or resilient insert materials are solidly engaged or filled in the cylindrical bag, such that the punching bags include a great weight and a great volume which are adverse for transportation or storing purposes.

In addition, the typical punching bags comprise one or more straps attached to the outer peripheral portion of the bags, for hanging purposes. However, the bags are normally made of leather, woven or non-woven materials, such that the straps may be easily disengaged from the bag, and the bag may be easily damaged or broken after use.

The other punching aids include a solid and heavy base for stably supporting on the ground. U.S. Pat. No. 6,106,443 to Kuo discloses one of the typical punching aids having a barrel provided in the upper portion thereof for receiving fluid therein. However, the center of gravity may be greatly elevated when the barrel is filled with water. In addition, the punching aid may not be hung onto any supporting members.

The present invention has arisen to mitigate and/or obviate the afore-described disadvantages of the conventional punching bags.

SUMMARY OF THE INVENTION

The primary objective of the present invention is to provide a punching bag including a solid hanging structure for stably hanging purposes.

In accordance with one aspect of the invention, there is provided a punching bag comprising a bag body including a chamber formed therein, a barrel engaged in the chamber of the bag body, and including a space formed therein, a container received in the space of the barrel, and including a chamber formed therein for receiving insert materials therein, the container including at least one ring attached on top for hanging purposes.

The container includes a port provided on top thereof for filling the insert materials into the chamber of the container.

The bag body includes an upper portion having a cover provided thereon, the cover includes at least one orifice formed therein for receiving the ring.

Further objectives and advantages of the present invention will bercome apparent from a careful reading of a detailed description provided hereinbelow, with appropriate reference to accompanying drawings.

DETAILED DESCRIPTION OF THE PREFERRED EMBODIMENT

Figure 1:
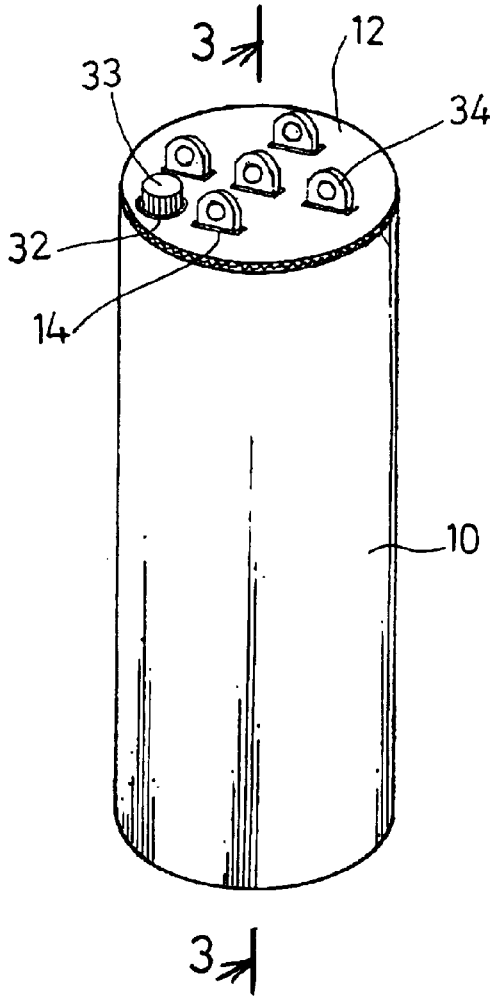
FIG. 1 is a perspective view of a punching bag in accordance with the present invention.
Figure 3:
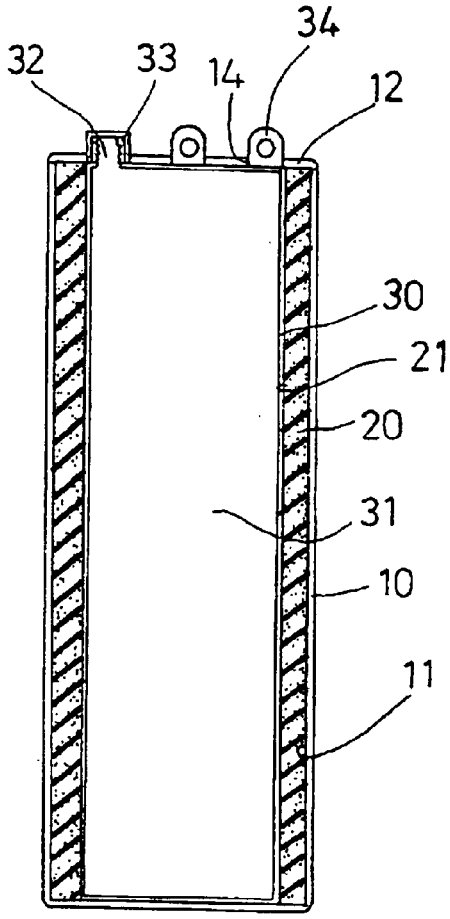
FIG. 3 is a cross sectional view taken along lines 3—3 of FIG. 1.
Figure 2:
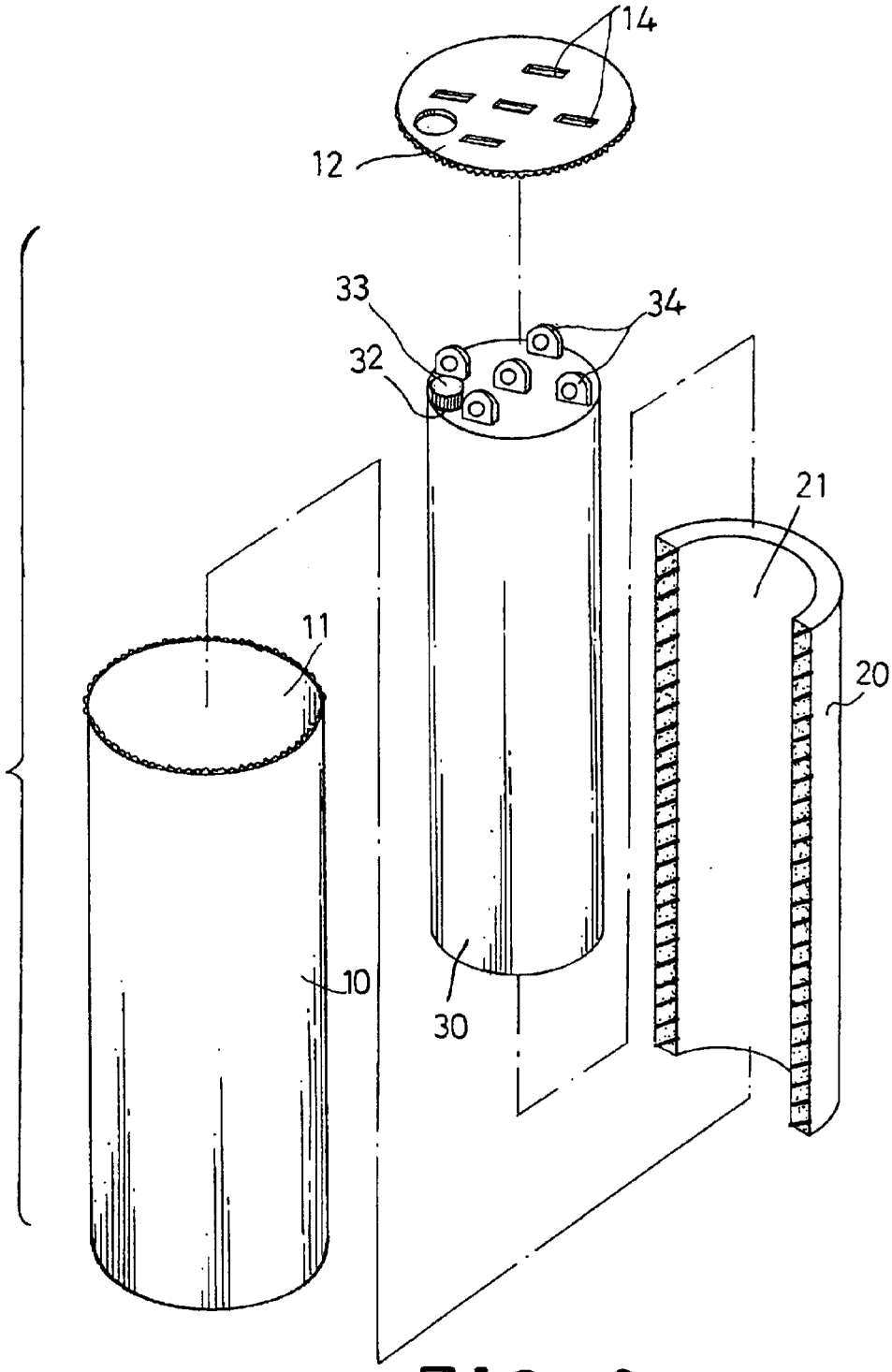
FIG. 2 is an exploded view of the punching bag.

Referring to the drawings, and initially to FIGS. 1–3, a punching bag in accordance with the present invention comprises a bag body 10 which may be formed into a cylindrical or the other shapes. The bag body 10 includes a chamber 11 formed therein, and may be made of leather, rubber, plastic, or the other synthetic materials.

A cover 12 is provided on top of the bag body 10 and includes a peripheral portion secured to the upper peripheral portion of the bag body 10 with such as the stitches, the zipper devices, or the like. The cover 12 includes one or more slits or orifices 14 formed therein, and may be made of leather, rubber, plastic, or the other synthetic materials.

A barrel 20 is received in the chamber 11 of the bag body 10, and is preferably made of resilient or soft materials, such as rubber, plastic, or the other synthetic materials, and includes a space 21 formed in the middle or center portion thereof.

A container 30 is received in the space 21 of the barrel 20, and includes a chamber 31 formed therein for receiving sand, water, or the other fluids or insert materials, and includes a port 32 provided on top for filling the sand, the water or the like into the chamber 31 of the container 30.

A cap 33 may be threaded onto the port 32 for enclosing the chamber 31 of the container 30, and for stably retaining the sand or the water or the insert materials within the chamber 31 of the container 30.

Figure 6:
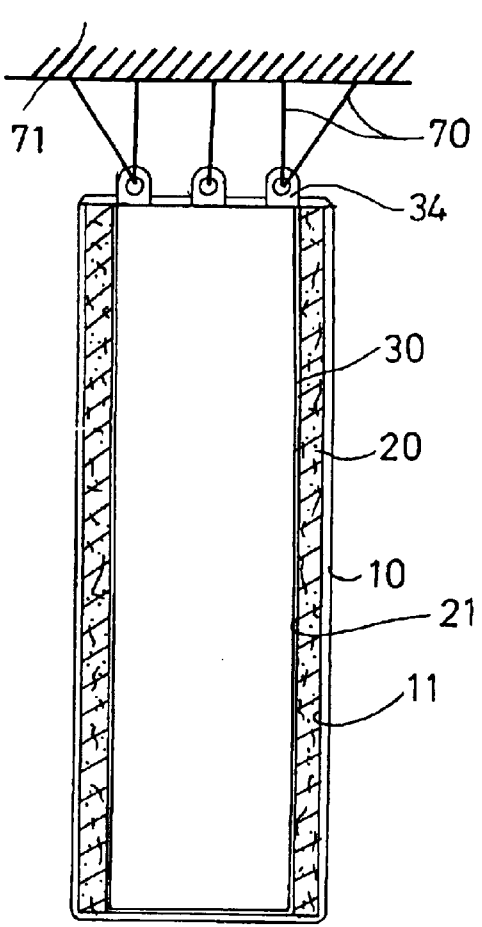
FIGS. 4, 5, 6 are cross sectional views similar to FIG. 3, illustrating the operation of the punching bag.
Figure 5:
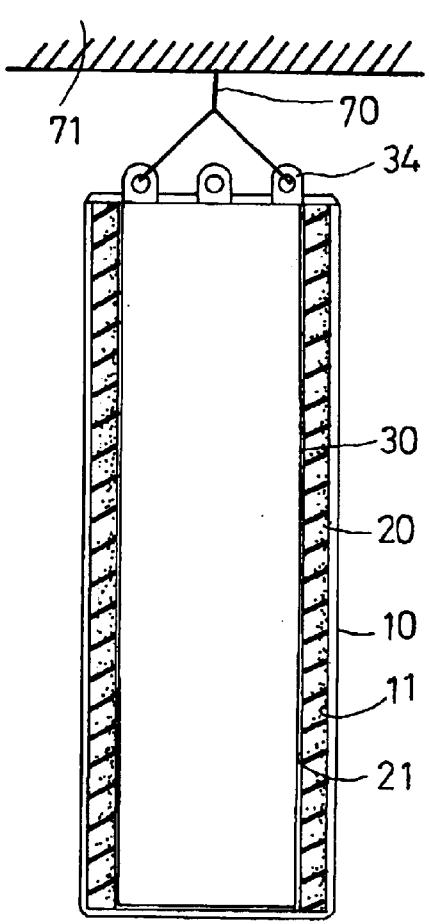
Figure 4:
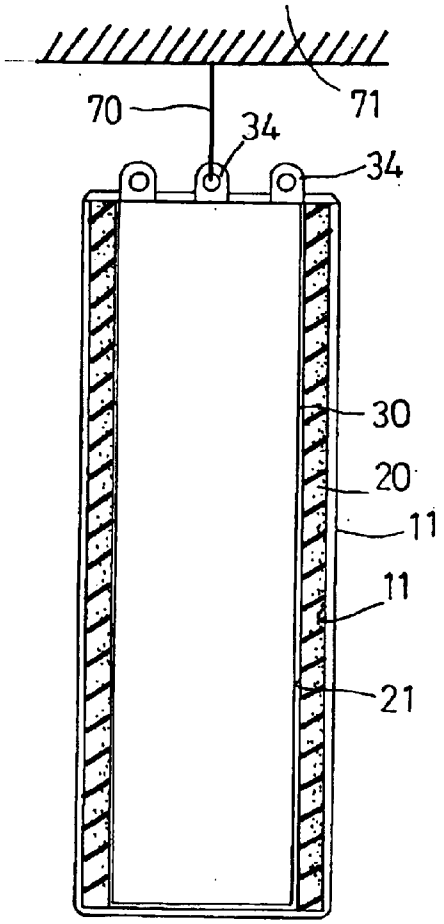

The container 30 includes one or more loops or hooks or rings 34 extended or provided on top thereof, and extended through the orifices 14 of the cover 12, for hooking or for hanging purposes, best shown in FIGS. 4–6.

One or more ropes or cables 70 may be coupled to one or more of the rings 34 for hanging the punching bag to any support member 71, such as the ceiling, the supporting rack, frame or the like.

The container 30 may be made of metal, plastic, composite materials, or the like, which may include a suitable strength or hardness, for allowing the punching bag to be solidly and stably hanging to the supporting member 71.

The rings 34 may be formed integral with the container 30, or may be made with metal or plastic materials separately, and then secured to the container 30 with fasteners, by welding processes, or the like.

In operation, as shown in FIGS. 4–6, the container 30 may be solidly hung onto or coupled to the supporting member 71 with one or more rings 34 and one or more cables 70. The barrel 20 may be stably attached or provided around the container 30 by the bag body 10.

While storing or transportation, the container 30 may be disengaged from the barrel 20 and the bag body 10, and the barrel 20 and the bag body 10 may be compressed to a planar structure, for facilitating the transportation or the storing purposes.

Accordingly, the punching bag in accordance with the present invention includes a solid hanging structure for stably hanging purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A punching bag comprising:

a bag body including a chamber formed therein, a barrel engaged in said chamber of said bag body, and including a space formed therein, a container received in said space of said barrel, and including a chamber formed therein for receiving insert materials therein, said container including at least one ring attached on top for hanging purposes.

2. The punching bag according to claim 1, wherein said container includes a port provided on top thereof for filling the insert materials into said chamber of said container.

3. The punching bag according to claim 1, wherein said bag body includes an upper portion having a cover provided thereon, said cover includes at least one orifice formed therein for receiving said at least one ring.

* * * * *